United States Patent [19]

De Martino

[11] 4,174,834

[45] Nov. 20, 1979

[54] STICK-PROPELLED DISK GAME

[76] Inventor: Aldo De Martino, 26 Dodge Ave., Akron, Ohio 44302

[21] Appl. No.: 838,465

[22] Filed: Oct. 3, 1977

[51] Int. Cl.[2] ..... A63B 65/10

[52] U.S. Cl. ..... 273/96 B; 46/74 D; 273/106 B

[58] Field of Search ..... 273/96 R, 96 B, 105.4, 273/100, 99, 106 B, 106 R; 46/74 D

[56] References Cited

U.S. PATENT DOCUMENTS

| | | | |
|---|---|---|---|
| 1,529,851 | 3/1925 | Smithson | 273/96 B |
| 2,690,339 | 9/1954 | Hall | 273/96 B |
| 3,359,678 | 12/1967 | Headrick | 46/74 D |
| 3,580,580 | 5/1971 | Wark | 273/100 |

*Primary Examiner*—William H. Grieb

*Attorney, Agent, or Firm*—Oldham, Oldham, Hudak & Weber

[57] ABSTRACT

A stick-propelled disk game is presented. Fundamentally, the invention includes an annular disk characterized by a central opening therein. The disk is caused to fly through the air and is retrieved therefrom by means of a stick which is insertable into the opening. The central opening and the outside circumference of the disk are circumscribed by circumferential edges of a greater thickness than the disk proper, such circumferential edges protruding equidistance above and below the surfaces of the disk portion therebetween. These circumferential edges, in combination with the disk surface, comprise a cup for aerodynamic stability, with such a cup existing on both sides of the disk.

3 Claims, 3 Drawing Figures

STICK-PROPELLED DISK GAME

BACKGROUND OF THE INVENTION

Heretofore it has been popular to use disks or saucers as throwing objects in games of skill as a recreational pastime. A game known as "Ring Toss" has been known wherein a doughnut-shaped rubber object is tossed from player to player. The skill of tossing and retrieving a "Flying Saucer," such as disclosed in U.S. Pat. No. 3,359,678, has been exercised by young and old alike. However, in known game devices of this nature, the distance of travel of the projectile has been somewhat limited due to the inherent weight of the projectile and/or its aerodynamic characteristics. Further, in such known devices, the projectile is released and retrieved by the user's hand, thus limiting the amount of skill necessary in playing a game with the device.

OBJECTS OF THE INVENTION

In light of the popularity of such game devices and further in light of the foregoing shortcomings in the prior art, it is an object of the instant invention to provide a stick-propelled disk game which includes a disk having a trajectory substantially greater than similar games heretofore known.

It is a further object of the invention to provide a stick-propelled disk game which includes a disk capable of traveling at higher speeds than those previously known while maintaining good aerodynamic characteristics to guarantee stability in flight.

Yet another object of the invention is to provide a stick-propelled disk game wherein a disk is both propelled and retrieved by a stick held by the user rather than by means of direct hand contact with the disk.

Yet another object of the invention is to provide a stick-propelled disk game wherein the disk is of an annular nature, having a central opening therein for engagement with a stick.

Still a further object of the invention is to provide a stick-propelled disk game which is simplistic in nature, readily adaptable for testing one's physical skill, and easily and inexpensively constructed utilizing state-of-the-art techniques.

SUMMARY OF THE INVENTION

The foregoing objects and other objects which will become apparent as the detailed description proceeds are achieved by a stick-propelled disk game, comprising: an annular disk having an opening centrally located with said disk; and at least one stick for engagement with said opening for propelling and for retrieving said disk.

DESCRIPTION OF THE DRAWING

For a complete understanding of the objects, techniques, and structure of the invention, reference should be had to the following detailed description and accompanying drawing wherein.

DETAILED DESCRIPTION OF THE PREFERRED EMBODIMENT

Figure 1:
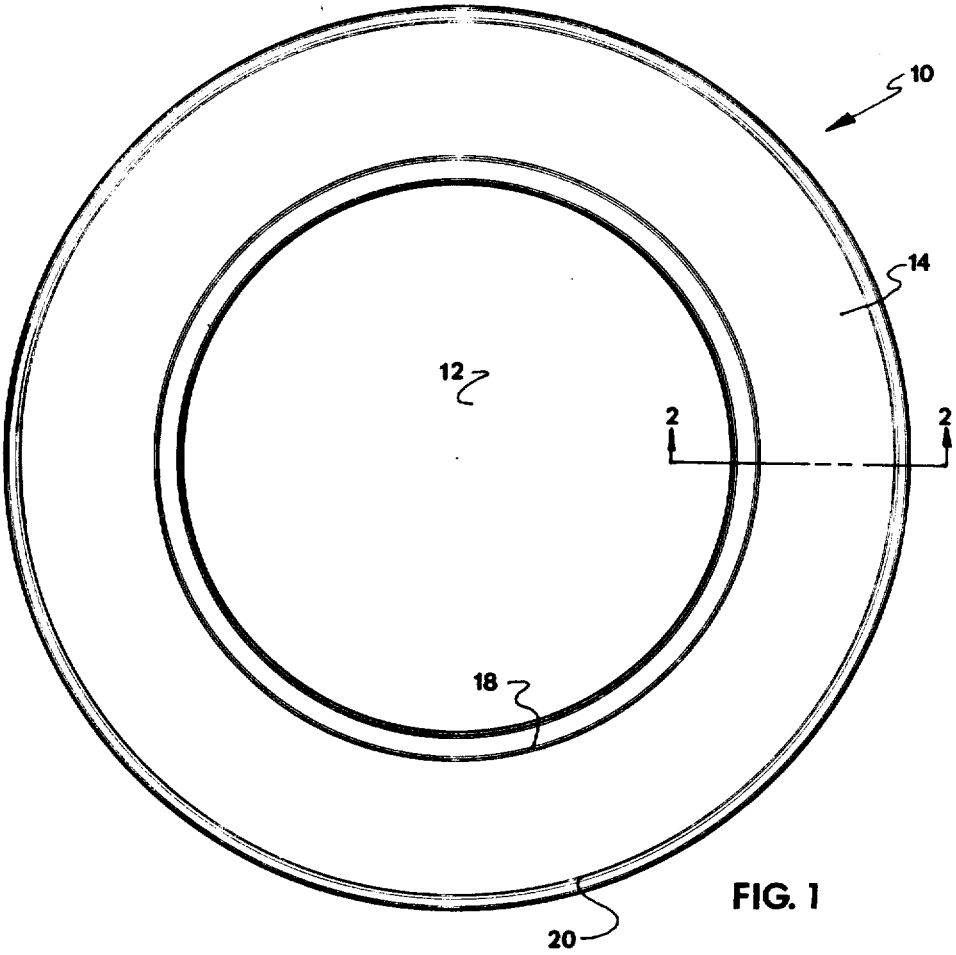
FIG. 1 is a top plan view of the annular disk portion of the invention.

Referring now to the drawing and more particularly to FIG. 1, it can be seen that a portion of the invention comprises a disk 10, which is of an annular nature. An inner opening 12 is defined by a circular rim 14. While the opening 12 and the rim 14 may vary somewhat with respect to their dimensional relationship, it is preferable that the inside diameter of the rim 14 be approximately 60% of the outside diameter thereof. In one embodiment of the invention, the inside diameter of the rim 14 is 10 inches while the outside diameter thereof is 16 inches. It has been found that, utilizing such proportionate dimensions, the opening 12 is sufficiently large to accommodate the sticks to be discussed hereinafter, while the rim 14 is of sufficient mass to enable the disk 10 to fly through the air.

Figure 2:
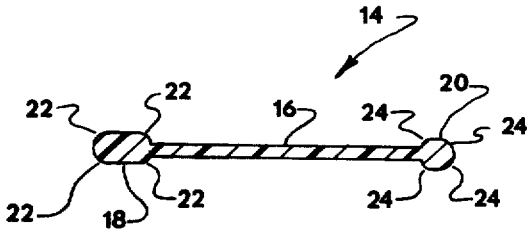
FIG. 2 is a cross-sectional view of the structure of FIG. 1 taken along the line 2—2.

With reference now to FIG. 2, a cross-sectional view of the rim 14, it can be seen that sum rim includes a central portion 16 and respective inner and outer circumferential edges 18,20. Preferably, the circumferential edges 18,20 are of a thickness on the order of three times that of the central portion 16. Further, the width of the inner circumferential edge 18 is approximately 15% of the overall width (OD-ID) of the rim 14. The width of the outer circumferential edge 20 is approximately one-half the width of the edge 18. With the proportionate dimensions just set forth, the mass of the annular disk 10 is concentrated toward the center thereof while still providing an outer edge which serves to strengthen and reinforce the disk as a whole. Further, with the edges 18,20 being approximately three times the thickness of the central portion 16, the central portion 16 provides an aerodynamic cup for lift purposes, the cup having a cross-sectional area equivalent to the width of the central portion 16 and a depth equivalent to one-third the thickness of the edges 18,20. In one embodiment of the invention, the central portion is 1/16 inch thick and 2¼ inches wide with the inner and outer circumferential edges 18,20 being 3/16 inch thick and ½ inch and ¼ wide, respectively.

As shown in FIG. 2, the rim 14 is symmetrical about a plane passing through the center line of the central portion 16, with the edge portions 18,20 extending equidistance above and below the upper and lower surfaces of the central portion 16. Hence, the disk 10 is reversible with the top and bottom thereof being characterized by identical aerodynamic cup characteristics and being capable of flight with either side of the central portion 16 acting as the aerodynamic cup. It should also be noted that the corners 22,24 of the circumferential edges 18,20 are rounded for safety purposes as well as for aerodynamic purposes to achieve the best laminar flow characteristic of the air over the disk 10 while in flight.

Figure 3:
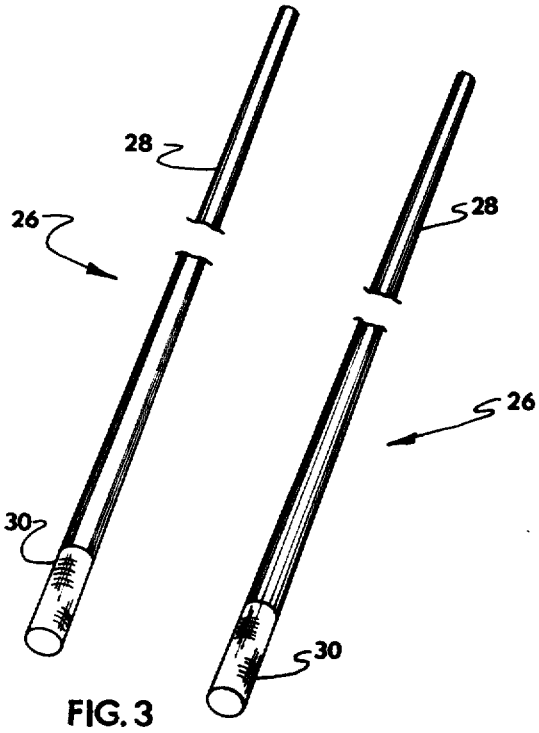
FIG. 3 is a pictorial illustration of the sticks utilized with the annular disk of FIG. 1 for propelling and retrieving such disk.

With reference now to FIG. 3, it can be seen that a portion of the stick-propelled disk game comprises one or more sticks 26 which may be of any suitable length, but which are preferably about 2 feet long, having a diameter of one inch at the handle 30, tapering to a diameter of ½ inch at the tip 28. Of course, the handle 30 may be knurled or notched to accommodate gripping by the user's hand.

While the disk 10 and the sticks 26 may be constructed of various suitable materials, it is preferred that the disk 10 be of a flexible and yet sturdy plastic construction such that an impact of the disk 10 with another object will result in a deflection of the disk 10 with no damage being done thereto. The sticks 26 may be of either wood or plastic construction.

In use, two or more players, each having a stick 26, propel the disk 10 between them while attempting to maneuver and manipulate the disk 10 with the stick 26. A player begins by placing the tip 28 of the stick 26 through the inner opening 12 of the disk 10. With the disk and stick so engaged, the user flings or whips the stick to disengage the disk 10 therefrom and cause the disk to fly through the air toward the other player who retrieves the disk by catching the same on his stick 26 by spearing or thrusting the stick 26 into the inner opening 12. This player then returns the disk to the first player by similarly flinging or whipping the stick by appropriate wrist and arm action. It will become readily apparent to the users of this game that significant skill can be developed such that certain wrist actions will make the disk soar, while others will make the disk curve or maintain a flat trajectory. In any event, numerous games and scoring techniques can be devised by the users to judge or determine their relative skills if they should so desire.

It should be appreciated that while the foregoing description has associated the use of the disk 10 with the sticks 26, the disk 10 may be propelled and retrieved solely by the user's hands. Thus, with the structure of the disk 10, one may obtain the benefits of its flatter trajectory, increased travel distance, and higher speed with or without the use of the sticks 26.

Thus it can be seen that the objects of the invention have been achieved by the structure presented hereinabove. While in accordance with the patent statutes, only the best mode and preferred embodiment of the invention has been presented and described in detail, it is to be understood that the invention is not limited thereto or thereby. Consequently, for an appreciation of the true scope and breadth of the invention, reference should be had to the following claims.

What is claimed is:

1. A stick-propelled disk game, comprising:

an annular disk having an opening centrally located within said disk, said disk having an inner circumferential edge about said opening having rounded edges for maintaining laminar flow of air over said disk during flight;

an outer circumferential edge about the outside circumference of said disk having rounded edges;

said circumferential edges being of a thickness greater than the thickness of the portion of said disk therebetween, such difference in thicknesses defining an aerodynamic cup between said circumferential edges;

said circumferential edges extending equidistance above and below the portion of said disk therebetween and thereby defining aerodynamic cups on upper and lower surfaces of said disk;

wherein said inner circumferential edge is of a width approximately equal to fifteen percent of the overall width of said disk between said opening and said outer circumferential edge of said disk, and wherein said outer circumferential edge is of a width approximately equal to one-half of the width of said inner circumferential edge; and at least one stick for engagement with said opening for propelling and retrieving said disk.

2. The stick-propelled disk game according to claim 1 wherein said circumferential edges are of a thickness approximately equal to three times the thickness of the portion of said disk therebetween, and wherein the mass of said inner circumferential edge is greater than the mass of said outer circumferential edge, concentrating the mass of said disk toward said opening.

3. The stick-propelled disk game according to claim 2 wherein said stick is tapered, being wider at a handle end thereof and tapering to an opposite end, said opposite end being insertable into said opening for retrieving and releasing said disk.

* * * * *